United States Patent [19]

Sugioka et al.

[11] Patent Number: 4,458,850

[45] Date of Patent: Jul. 10, 1984

[54] BOBBIN HOLDER

[75] Inventors: Takami Sugioka; Yuzuru Miyake; Shoichi Murakami; Hideaki Ibuki, all of Matsuyama, Japan

[73] Assignee: Teijin Seiki Co., Ltd., Osaka, Japan

[21] Appl. No.: 437,522

[22] Filed: Oct. 29, 1982

[30] Foreign Application Priority Data

Oct. 30, 1981 [JP] Japan ..... 56-161143[U]

[51] Int. Cl.[3] ..... B65H 54/54; B65H 75/30

[52] U.S. Cl. ..... 242/46.4; 242/46.6

[58] Field of Search ..... 242/46.2, 46.3, 46.4, 242/46.6, 72, 72.1, 68, 68.1, 68.2

[56] References Cited

U.S. PATENT DOCUMENTS

| | | | |
|---|---|---|---|
| 1,635,525 | 7/1927 | Anderson | 242/46.3 |
| 2,564,746 | 8/1951 | Bauer | 242/46.6 |
| 3,398,907 | 8/1968 | Heumann | 242/46.4 |
| 3,462,092 | 8/1969 | Mullins | 242/46.4 |
| 3,494,565 | 2/1970 | Mullins | 242/46.4 |
| 3,495,781 | 2/1970 | Graf et al. | 242/46.4 |
| 3,554,455 | 1/1971 | Graf | 242/46.4 |
| 3,779,472 | 12/1973 | Boggs | 242/46.4 X |
| 3,813,051 | 5/1974 | Miller | 242/46.4 |
| 3,833,179 | 9/1974 | Maurer | 242/46.4 |
| 4,154,412 | 5/1979 | Briar et al. | 242/46.4 |

FOREIGN PATENT DOCUMENTS

| | | | |
|---|---|---|---|
| 1531608 | 5/1968 | France | 242/46.2 |

*Primary Examiner*—Stanley N. Gilreath

*Attorney, Agent, or Firm*—Burgess, Ryan and Wayne

[57] ABSTRACT

A bobbin holder comprises a rotatable support device and a holding device mounted on the support device for holding a bobbin inserted thereon. The bobbin holding device comprises a pair of bobbin holding members made of an elastomer. Each bobbin holding member has a cylindrical portion and a coned disc portion extending from the cylindrical portion and having an outer surface for engaging the bobbin. The bobbin holding device further includes a cylindrical spacer inerted onto the cylindrical portions of the pair of bobbin holding members, and a device for axially urging the coned disc portions of the bobbin holding members so as to expand said coned disc portions.

5 Claims, 4 Drawing Figures

R
L
3
1c
4
2
14
1a
1b
6a
1
6
1d
7
6b
1e
10
9
8
15
11a
12
13
11
5a
5
5b
5c
1f

R
L
3
14
1c
4
2
1a
1f
1b
6a
6d
1
6
6c
7
6b
11
9
8
16
11a
12
13
10
18
1e
17b
17
15
17a
5a
5
5b

BOBBIN HOLDER

TECHNICAL FIELD TO WHICH THE INVENTION RELATES

The present invention relates to a bobbin holder of a high speed yarn winding apparatus utilized for winding a yarn, especially a thermoplastic synthetic yarn, such as a polyester yarn or a nylon yarn, on a bobbin at a high speed, for example, of at least 4000 m/min.

RELEVANT BACKGROUND ART

Bobbin holders have been utilized in conventional yarn winding apparatus for supporting bobbins from the inside thereof. Typical bobbin holders utilized at a high speed have coned disc members made of metallic material and inserted onto a holder body, i.e., rotatable spindle. The coned disc members are axially urged to radially expand when they hold bobbins, and they are axially retracted to radially reduce when they release bobbins.

However, such conventional bobbin holders have a defect that they easily damage the inner surfaces of bobbins because of the following reasons.

Since the coned disc members are made of metallic material which is harder than paper or plastic, of which bobbins are made, the coned disc members damage the inner surfaces of the bobbins.

Since metallic material, of which coned disc members are made, have a large specific weight, it is necessary to reduce the thickness of the coned disc members in order to reduce their weight. The contacting area between the coned disc members and the bobbins becomes small, when the thickness of the coned disc members is reduced, and accordingly, the pressure exerted at the contacting area increases. As a result, the bobbin made of paper or plastic is easily damaged.

Because of the above-described reasons, bobbins are often damaged by the metallic coned disc members utilized in conventional bobbin holders, especially when such conventional yarn winding apparatus are utilized for a high speed winding, wherein the yarn winding speed exceed 4,000 m/min, due to the centrifugal force. In addition, the coned disc members frequently result in the deformation of bobbins due to the centrifugal force and adversely affect the quality of yarn wound on the bobbin.

In addition to the above-described defect, the above-described conventional bobbin holders also have a defect that they are damaged and ruptured due to the centrifugal force when they are rotated while an operator forgets to insert a bobbin thereonto.

SUMMARY OF THE INVENTION

An object of the present invention is to eliminate the above-described defects which are inherent in the conventional bobbin holders.

Another object of the present invention is to provide a bobbin holder which does not easily damage a bobbin inserted thereon.

A still other object of the present invention is to provide a bobbin holder which is not damaged nor ruptured due to the centrifugal force even when it is rotated at a high speed while an operator forgets to insert a bobbin thereonto.

A bobbin holder according to the present invention comprises a rotatable support means and a holding means mounted on said support means for holding a bobbin inserted thereon. The holding means is characterized in that it comprises:

at least a pair of bobbin holding members made of an elastomer;

the holding members being provided with cylindrical portions, having a small diameter and engaging with the support means; and coned disc portions extending outwardly from the cylindrical portions, the outer surfaces thereof engaging with the bobbin;

a cylindrical spacer inserted onto the cylindrical portions of the pair of bobbin holding members; and a means for axially urging the coned disc portions of the bobbin holding members so as to expand the coned disc portions.

The term "elastomer" used in the present specification and the claims includes a natural rubber, synthetic rubber or suitable plastics.

BRIEF DESCRIPTION OF THE ACCOMPANYING DRAWINGS

The present invention will now be explained in detail with reference to the accompanying drawings, wherein.

DETAILED DESCRIPTION OF THE INVENTION

Figure 1:
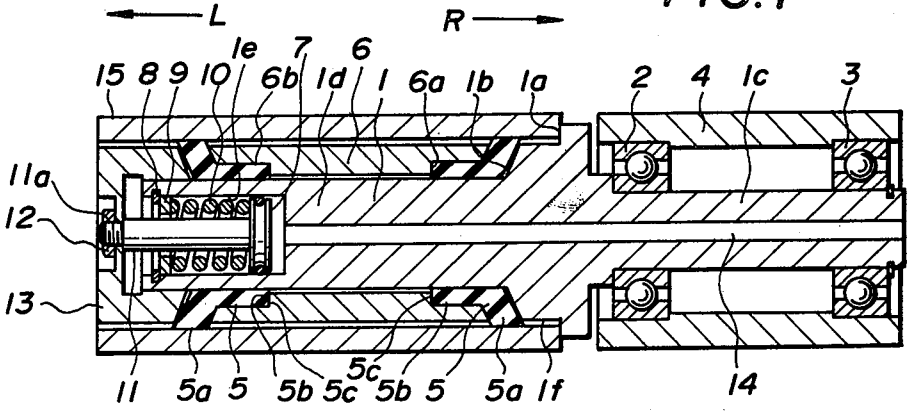
FIG. 1 is a cross sectional view of a bobbin holder according to the present invention.

Referring to FIG. 1, a bobbin holder body 1 which constitutes a support means of the present invention has a circular cross section and has two shoulders 1*a* and 1*b* formed at the longitudinally central portion thereof. The rear portion 1*c* (which is illustrated at the right portion in FIG. 1) of the bobbin holder body 1 is rotatably supported on a machine frame 4 of a yarn winding apparatus by means of a pair of bearings 2 and 3. The shoulder 1*a* located near the rear portion 1*c* serves as a stop for abutting against a bobbin 15 inserted onto the bobbin holder of the present invention. The shoulder 1*b* formed at a position near the front end of the bobbin holder body 1 serves as a stop for abutting against one of bobbin holding members 5 which will be explained later.

The bobbin holding members 5 are made of an elastomer, i.e., a non-metallic elastic material such as a natural rubber, synthetic rubber or suitable plastics. The bobbin holding members comprises cylindrical portions 5*b* and coned disc portions 5*a*. The cylindrical portions 5*b* have a small diameter band which rigidly engages with the bobbin holder body 1. The coned disc portions 5*a* extend inclinedly and outwardly from the cylindrical portions 5*b* to form tapered surfaces and are formed in a disc shape. In the embodiment illustrated in FIG. 1, the two bobbin holding members 5 are inserted onto the front portion 1*d* of the bobbin holder body 1 in such a manner that the tapered portions of the bobbin holding members 5 face each other.

A spacer 6 made of a rigid material such as a metal is inserted onto the cylindrical portion 5*b* of the bobbin holding members 5 to transmit urging force from one of the bobbin holding members to the other. The spacer 6 is formed in a cylinder and has shoulders 6a and 6b formed at ends thereof, which engage with the end surfaces 5c of the cylindrical portions 5b of the bobbin holding members 5.

The front portion 1d has a cavity 1e formed therein with which a piston 7 is sealingly and slidably engaged. A ring seat 9 is detachably fixed to the inner surface of the cavity 1e by means of a stop ring 8. A coil compression spring 10 which is an axially urging means of the present invention is disposed between the piston 7 and the ring seat 9 so that the piston 7 is urged to the right as indicated by arrow R towards the machine frame 4 by means of the spring 10.

A piston rod 11 is connected to the piston 7 and has a screw 11a formed at the front end thereof. A cap 13 slidably engages with the outer surface of the front portion 1d of the bobbin holder body 1 and is secured to the piston rod 11 by threading a nut 12 onto the screw 11a. As a result, the cap 13 urges the left surface of the holding member 5 which is inserted at a position between the cap 13 and the spacer 6 and which is located near the front portion of the bobbin holding body 1.

A longitudinal aperture 14 is formed within the bobbin holder body 1. One end of the aperture 14 is communicated with the cavity 1e, and the other end of the aperture 14 is communicated with a compressed air source (not shown), so that compressed air having a predetermined pressure can be introduced into the cavity 1e. When compressed air is introduced into the cavity 1e, the piston 7 is moved to the left indicated by arrow L by means of the pneumatic force exerted by the compressed air against the force of the spring 10.

The outer diameters of the cap 13, spacer 6 and the intermediate portion 1f located between the shoulders 1a and 1b of the bobbin holder body 1 are substantially identical and are slightly smaller than the inner diameter of the bobbin 15.

When a bobbin 15 is inserted onto the bobbin holder of the present invention which has a construction as described above, compressed air of a predetermined pressure is supplied into the cavity 1e from the compressed air source (not shown) through the longitudinal aperture 14. As a result, the piston 7 is moved to the left as indicated by arrow L for a predetermined distance against the force of the spring 10. Due to the movement of the piston 7, the urging forces which have been exerted on the holding members 5 and the spacer 6 are released. Accordingly, the coned disc portions 5d of the bobbin holding members 5 become free from the urging force, and the coned disc portions 5d of the bobbin holding members return to their contracted states wherein the outer diameter of the coned disc portions 5d is its original value. The bobbin 15 is inserted onto the bobbin holder wherein the coned disc portions 5d are contracted as described above. Then, compressed air is released from the cavity 1e through the aperture 14, and therefore, the piston 7 is moved to the right as designated by arrow R by means of the spring 10. Together with the piston 7, the piston rod 11 connected to the piston 7 and the cap 13 connected to the piston rod 11 move to the right as designated by arrow R to press the left holding member 5. The urging force exerted by the spring 10 is transmitted from the left holding member 5 to the right holding member 5 by means of the spacer 6. As a result, the coned disc portions 5b of the bobbin holding members 5 are compressed and the outer diameter of the coned disc portions 5b is expanded to frictionally engage with the inner surfaces of the bobbin 15 and rigidly hold the bobbins 15.

In the present invention, an elastomer, i.e., a non-metallic elastic material such as a natural rubber, synthetic rubber or suitable plastics, is used to construct a bobbin holding member for holding the bobbins 15, the bobbin holding members 5 do not injure the inner surfaces of the bobbins nor deform the bobbins 15 at all. In addition, in the present invention, the coned disc portions 5a are connected to the cylindrical portions 5b at their ends having a small diameter. The spacer 6 is located at a position between the bobbin holding members 5 and is inserted onto two cylindrical portions 5b of the bobbin holding members 5. Accordingly, the expansion of the cylindrical portions 5b is restricted by the spacer 6, and therefore, the bobbin holding members 5 do not excessively expand even when they are rotated while operators forget to insert bobbins 15 thereonto. As described above, the bobbin holder of the present invention is not easily damaged even when it is rotated without any bobbin.

As described above, the elastomer forming the bobbin holding members 5 is a non-metallic elastic material such as a natural rubber, synthetic rubber or suitable plastics, and among the synthetic rubber, polyurethane rubber, butyl rubber or nitrile rubber is suitable for the elastomer. It is preferable that the hardness of the elastomer is between about 40 and 70 in Hs.

It is also preferable that the rigidity of the bobbin holding member 5 located near the rear portion 1c of the bobbin holder body 1 is slightly smaller than that of the bobbin holding member 5 located at the front portion 1d of the bobbin holder body 1. If the rigidities of the bobbin holding members 5 are different from each other as described above, the bobbin holding member 5 located at the rear portion 1c expands prior to that located at the front portion 1d when the bobbin holding members 5 are compressed by means of the spring 10, and accordingly, the holding of the bobbin 15 by means of the bobbin holding members 5 is ensured. The rigidity of the holding members 5 can be adjusted by varying the contents of synthetic rubber, changing the cross linking agent, adjusting the hardness or changing the mechanical design of the holding members 5, for example, formation of slits in the members. If the hardness of the member is adjusted, it is recommended that the difference in the hardness between the bobbin holding members 5 located at the rear and front portions 1c and 1d is in a range between 5 and 15 in Hs.

Figure 2:
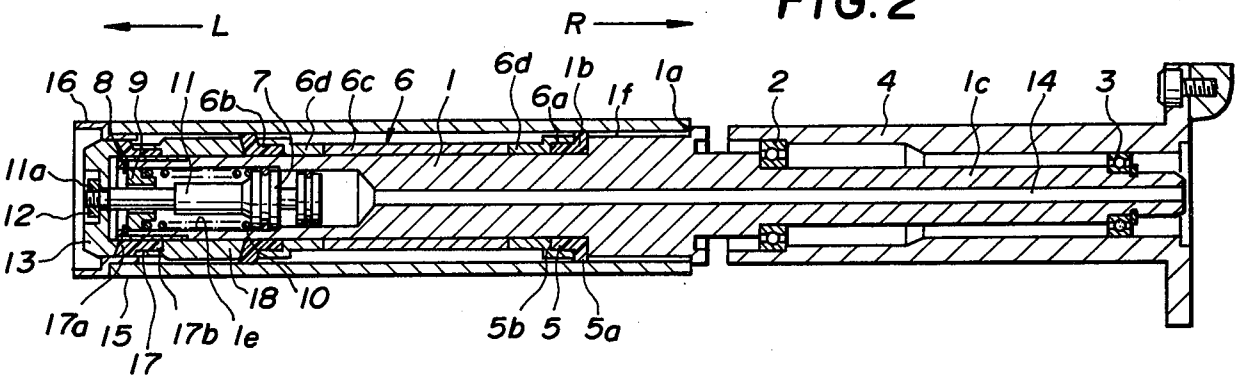
FIG. 2 is a cross sectional view of another bobbin holder according to the present invention.

In the embodiment described above, only a bobbin is held by means of the bobbin holder of the present invention. However, the present invention is also applicable to a bobbin holder for holding both a bobbin and a yarn catch ring attached to one end of the bobbin to catch a yarn end. An embodiment of this type is illustrated in FIG. 2. Referring to FIG. 2, a catch ring 16 is inserted into the left end of the bobbin 15 to catch a yarn (not shown). The bobbin holder of this embodiment is very similar to that explained above except: that the bobbin holding means of this embodiment includes a third holding member 17 to hold the catch ring 16 in addition to the above-explained bobbin holding member 5; and that the spacer 6 comprises three parts, i.e., a central cylinder 6c and two end members 6d located at both the ends of the central cylinder 6a and having a crank shape cross section. Accordingly, similar parts are denoted by the same reference numerals as those used in FIG. 1 and further detailed explanation therefor is omitted. Similarly since the construction of the third bobbin holding member 17 is very similar to that of the above described bobbin holding members 5, similar portions of the third holding member 17 are denoted by reference numerals with the same suffix and further detailed explanation therefor is also omitted. A second spacer 18 is disposed between the third bobbin holding member 17 and the bobbin holding member 5 located at the front portion of the bobbin holding body 1 in order to transmit the urging force exerted by the spring 10.

Figure 3:
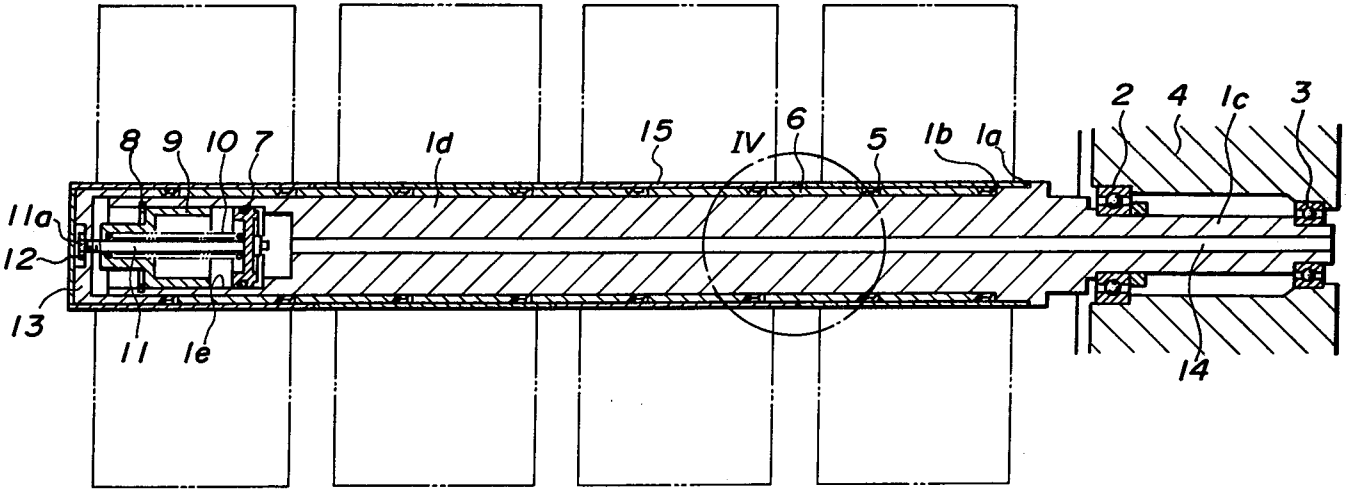
FIG. 3 is a cross sectional view of a still other bobbin holder according to the present invention.
Figure 4:
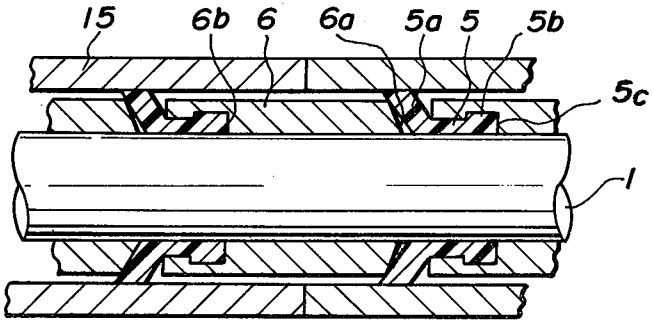
FIG. 4 is an enlarged cross sectional view of the portion IV in FIG. 3.

In the above-described embodiments, one bobbin is inserted onto the bobbin holder according to the present invention. However, the present invention is also applicable to a bobbin holder which is utilized to hold a plurality of bobbins inserted thereon so as to simultaneously take up a plurality of yarns. An example of this type will now be explained with reference to FIG. 3, wherein four bobbins 15 are simultaneously held on a single bobbin holder. Four pairs of the bobbin holding members 5 are disposed in such a manner that the pair of bobbin holding members 5 correspond to the bobbins, respectively. In addition, seven spacers 6 are disposed at the spaces formed between the four pairs of bobbin holding members 5. In this example, the coned disc portions 5*a* are disposed so that the tapered surfaces aligned in one direction.

As is apparent from the description above, according to the present invention, the defects which are inherent to conventional bobbin holders can be eliminated. More specifically, the bobbin holder of the present invention does not easily damage a bobbin inserted thereon. The bobbin holder of the present invention is not damaged due to the centrifugal force even when it is rotated at a high speed while an operator forgets to insert a bobbin thereonto. As a result, a bobbin holder according to the present invention results in tremendously large advantages when it is used as a bobbin holder of a high speed yarn winding apparatus.

We claim:

1. A bobbin holder comprising a rotable cylindrical support mounted on a frame, said support having a front end and a base portion axially spaced from said front end and secured to the frame, and a bobbin holding means mounted on said support means for holding a bobbin inserted thereon, said bobbin holding means comprising:

first and second axially spaced unitary elastomeric bobbin holding members, each of said members having an axially extending cylindrical portion closely surrounding said support and a frustoconical portion extending from one end of said cylindrical portion outwardly flared therefrom, the end of said frustoconical portion adjacent said cylindrical portion having substantially the same diameter as said cylindrical portion, and the free end of said frustoconical portion having a greater diameter than said cylindrical portion;

cylindrical substantially rigid spacer means surrounding said support and mounted for axial movement with respect thereto, said spacer means having a first portion engaging at least one of said bobbin holding members and surrounding the cylindrical portion of the engaged bobbin holding member, for axial movement of said engaged bobbin holding member with said first portion of said spacer means, said spacer means having a second portion adjacent the free end of the frustoconical portion of the engaged bobbin holding member, the outer diameter of said spacer means being no greater than the diameter of said free end of said frustoconical portion of said engaged bobbin holding member; and means for urging said first and second portions of said spacer means toward each other to compress at least a part of the frustoconical portion of said engaged bobbin holding member to cause the diameter of the free end thereof to increase to a value significantly greater than the outer diameter of said spacer means, so that said free end may engage the inner cylindrical surface of a bobbin mounted on said support and surrounding said free end of said frustoconical portion of said engaged bobbin holding member.

2. A bobbin holder comprising a rotable cylindrical support mounted on a frame, said support having a front end and a base portion axially spaced from said front end and secured to the frame, and a bobbin holding means mounted on said support means for holding a bobbin inserted thereon, said bobbin holding means comprising:

first and second axially spaced unitary elastomeric bobbin holding members, each of said members having an axially extending cylindrical portion closely surrounding said support and a frustoconical portion extending from one end of said cylindrical portion and outwardly flared therefrom, the end of said frustoconical portion adjacent said cylindrical portion having substantially the same diameter as said cylindrical portion, and the free end of said frustoconical portion having a greater diameter than said cylindrical portion, the said same portions of said bobbin holding members facing each other;

cylindrical substantially rigid spacer means surrounding said support and mounted for axial movement with respect thereto, said spacer means having a first portion engaging at least one of said bobbin holding members and surrounding the cylindrical portion of the engaged bobbin holding member, for axial movement of said engaged bobbin holding member with said first portion of said spacer means, said spacer means having a second portion adjacent the free end of the frustoconical portion of the engaged bobbin holding member, the outer diameter of said spacer means being no greater than the diameter of said free end of said frustoconical portion of said engaged bobbin holding member; and means for urging said first and second portions of said spacer means toward each other to compress at least a part of the frustoconical portion of said engaged bobbin holding member to cause the diameter of the free end thereof to increase to a value significantly greater than the outer diameter of said spacer means, so that said free end may engage the inner cylindrical surface of a bobbin mounted on said support and surrounding said free end of said frustoconical portion of said engaged bobbin holding member.

3. A bobbin holder comprising a rotatable cylindrical support mounted on a frame, said support having a front end and a base portion axially spaced from said front end and secured to the frame, and a bobbin holding means mounted on said support means for holding a bobbin inserted thereon, said bobbin holding means comprising:

first and second axially spaced unitary elastomeric bobbin holding members, each of said members having an axially extending cylindrical portion closely surrounding said support and a frustoconical portion extending from one end of said cylindrical portion and outwardly flared therefrom, the end of said frustoconical portion adjacent said cylindrical portion having substantially the same diameter as said cylindrical portion, and the free end of said frustoconical portion having a greater diameter than said cylindrical portion; the cylindrial portions of said bobbin holding members being relatively remote from said front end of said support, and the frustoconical portions of said bobbin holding members being relatively close thereto, so that said frustoconical portions flare out toward said front end of said support to facilitate removal of a bobbin from said bobbin holding means, cylindrical substantially rigid spacer means surrounding said support and mounted for axial movement with respect thereto, said spacer means having a first portion engaging at least one of said bobbin holding members and surrounding the cylindrical portion of the engaged bobbin holding member, for axial movement of said engaged bobbin holding member with said first portion of said spacer means, said spacer means having a second portion adjacent the free end of the frustoconical portion of the engaged bobbin holding member, the outher diameter of said space means being no greater than the diameter of said free end of said frustoconial portion of said engaged bobbin holding member; and means for urging said first and second portions of said spacer means toward each other to compress at least a part of the frustoconical portion of said engaged bobbin holding member to cause the diameter of the free end thereof to increase to a value significantly greater than the outer diameter of said spacer means, so that said free end may engage the inner cylindrical surface of a bobbin mounted on said support and surrounding said free end of said frustoconical portion of said engaged bobbin holding member.

4. A bobbin holder according to claim 1, 2 or 3 wherein the rigidities of said holding members are different from each other.

5. A bobbin holder according to claim 4 wherein the bobbin holding member having a smaller rigidity is located at the base portion of said support and the bobbin holding member having a larger rigidity is located near the front end of said support.

* * * * *